US005817995A

United States Patent [19]

Wojtanek

[11] Patent Number: 5,817,995

[45] Date of Patent: Oct. 6, 1998

[54] WIPE/WASH SWITCH

[75] Inventor: Guy A. Wojtanek, West Chicago, Ill.

[73] Assignee: Eaton Corporation, Cleveland, Ohio

[21] Appl. No.: 969,663

[22] Filed: Oct. 30, 1992

[51] Int. Cl.[6] ..... H01H 25/06

[52] U.S. Cl. ..... 200/4

[58] Field of Search ..... 200/4, 5 R, 6 R, 200/6 A, 17 R, 18, 52 R, 61.27, 61.54, 339, 553

[56] References Cited

U.S. PATENT DOCUMENTS

| | | | |
|---|---|---|---|
| 2,672,531 | 3/1954 | Stevenson | 200/4 |
| 3,772,484 | 11/1973 | Roeser | 200/4 |
| 3,858,012 | 12/1974 | Lockard | 200/6 |
| 3,894,203 | 7/1975 | Diehr | 200/6 |
| 5,047,596 | 9/1991 | Ebishi | 200/4 |
| 5,099,091 | 3/1992 | Kokubu | 200/5 B |

*Primary Examiner*—Michael A. Friedhofer
*Attorney, Agent, or Firm*—Roger A. Johnston

[57] ABSTRACT

A rocker type windshield wiper motor control switch with a push-to-actuate function for controlling a windshield washer pump motor. The rocker member is pivoted on a sliding collar member slidable on the switch housing. A plurality of arcuate contact strips for effecting switching of the wiper motor circuit are mounted on the housing. Upon user pivotal movement of the rocker, a first shorting contact switches power on the contact strip to the wiper motor circuit irrespective of the position of the sliding collar. A second shorting contact switches power between separate arcuate contact strips upon user effecting sliding movement of the collar member irrespective of the pivotal position of the rocker.

1 Claim, 2 Drawing Sheets

WIPE/WASH SWITCH

BACKGROUND OF THE INVENTION

The present invention relates to rocker type switches employed for controlling windshield wiper motors and the washer pump operations. In such applications, it has been found particularly desirable from the function and aesthetic standpoint to employ rocker type switches; and, in windshield wiper/washer controls, it has been found particularly satisfactory to combine the rocker type switch motion with a push-to-actuate function for energizing the windshield washer function. It has also been desirable to provide for nighttime illumination of such rocker type switches for user convenience.

Heretofore, rocker type switches employed for control of automotive windshield wiper motors which have combined a push-to-actuate feature for control of the windshield washer have proven difficult to manufacture because the push-to-actuate wash function required that the switching function for the washer motor be accomplished in a plurality of pivoted positions of the rocker for the wiper motor control. It is known in manufacturing such switches to provide that the user actuated rocker member engage and move a slide switch for wiper motor control irrespective of the position of the rocker for the push-to-actuate function; and, heretofore the push-to-actuate function for the washer motor switch has operated a slide switch irrespective of the pivoted position of the rocker member.

Accordingly, it has been desired to provide a simplified and easier to manufacture design for a wash/wipe switch having the wiper motor controlled by a rocker member and the windshield washer pump motor controlled by push-to-actuate movement of the rocker member. It has been further desired to provide such a combination rocker type wiper motor switch with a center "OFF" and clockwise "ON" for continuous wiper motor operation, and counter-clockwise "ON" for intermittent wiper motor operation while maintaining the push-to-actuate function for switching "ON" of the windshield washer pump motor.

SUMMARY OF THE INVENTION

The present invention provides a unique wiper/wash switch for control of an automotive windshield wiper motor and separate actuation of the windshield washer pump motor. The switch of the present invention employs a user actuated rocker member pivotally mounted on a sliding collar member slidably mounted on the switch housing. The rocker member is actuated between a center "OFF" and counter-clockwise intermittent "ON" and clockwise continuous "ON" positions for control of the windshield wiper motor. Upon user pushing of the rocker member, the sliding collar moves to an inward position in which the windshield washer pump is energized irrespective of the pivoted position of the rocker member.

The switch of the present invention employs a plurality of arcuately shaped contact strips disposed on the inside of the housing, and a first and second shorting contact mounted on the portion of the rocker extending into the housing. The contact strips are arranged in sets and include detent means for the pivotal and push-to-actuate motion. With the collar in the unpushed or outward position, pivotal movement of the rocker member in either clockwise or counter-clockwise direction from the center "OFF" position effects switching "ON" of the wiper motor circuit by movement of the first shorting contact across discontinuities in the arcuate strips.

Upon inward movement of the sliding collar by the user pushing on the rocker member, the shorting contact switches maintain power to the wiper motor as determined by the pivotal position of the rocker member. A second shorting contact disposed on the rocker member switches between a separate set of arcuately disposed contact strips on the housing for effecting closing of a separate circuit to a washer motor upon inward movement of the collar and rocker member. The second shorting contact maintains power to the washer motor in the inward position of the collar and rocker irrespective of the pivotal position of the rocker member for providing the wash function in either of the "ON" positions of the rocker member.

In the unique wipe/wash switch of the present invention, the engagement of shorting contacts on the rocker member with stationary contact strips effects the separate switching functions by sliding contact on discrete stationary contact strips to provide a simplified switch construction, yet give the desired pivotal rocker action and push-to-actuate function.

DETAILED DESCRIPTION

Figure 1:
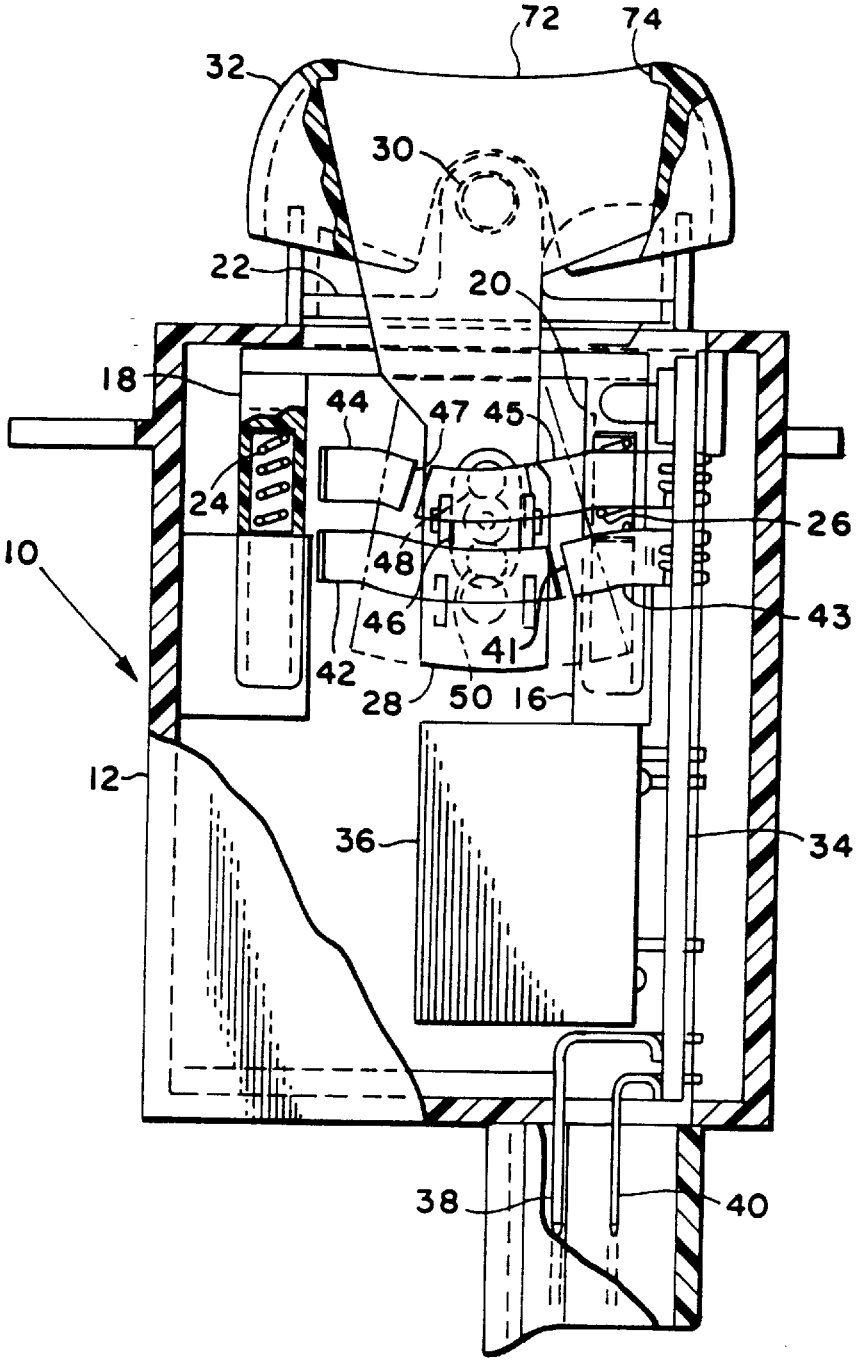
FIG. 1 is a left side view of the switch with portions of the housing broken away; and, FIG. 2 is a right side view of the switch with portions of the housing broken away.
Figure 2:
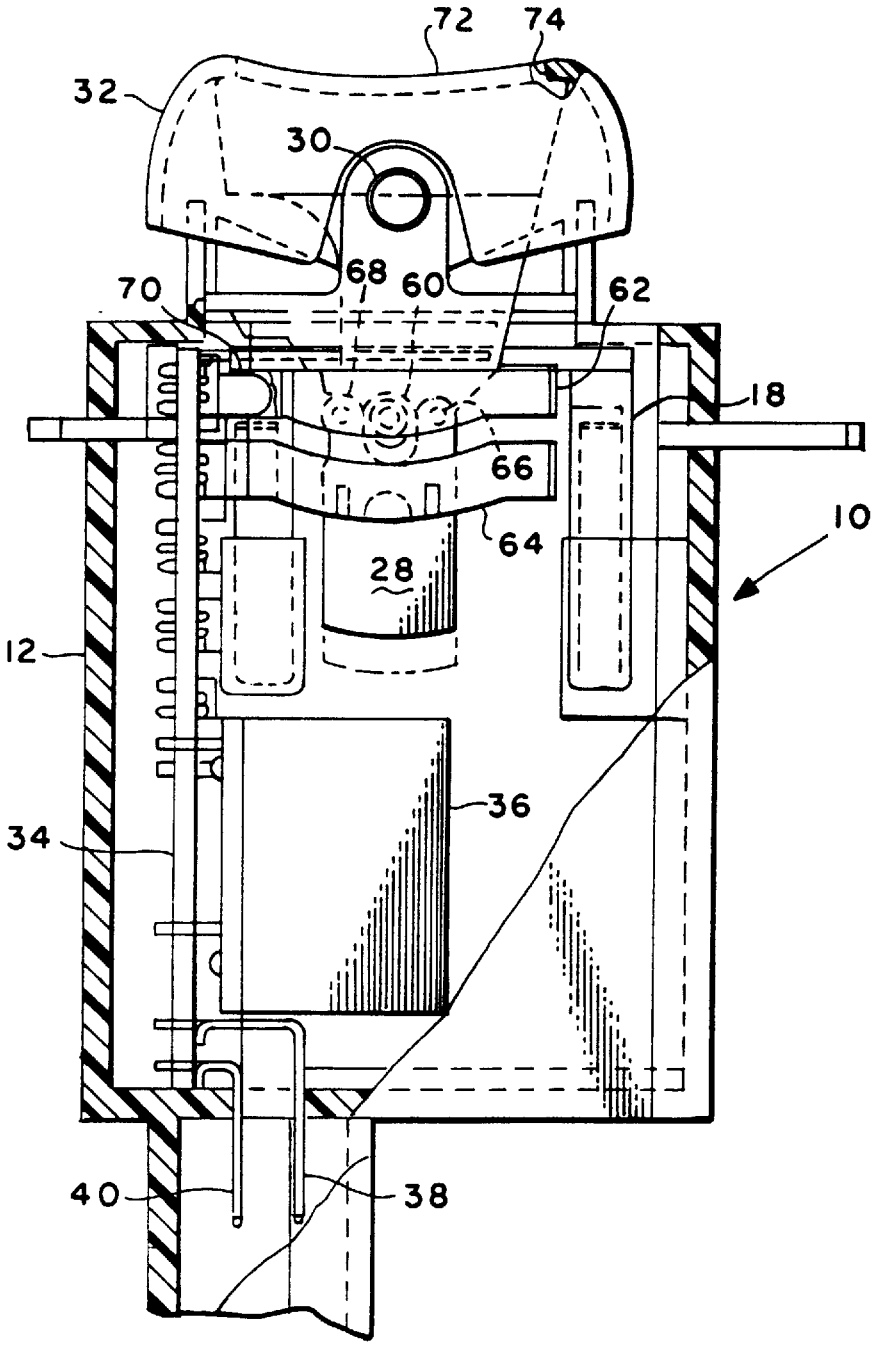

Referring to FIGS. 1 and 2, the switch assembly indicated generally at 10 has the housing 12 provided interiorly with guides 14,16 into which are slidably received a pair of spaced posts 18,20 which form the interior portions of a slider member 22 slidably received therein and biased outwardly by springs 24,26. The slider member has pivotally mounted thereon a rocker member 28. The rocker member is pivoted about lugs or pin 30 and has interior portions thereof extending into the housing which are formed of translucent material to function as a light pipe. The exterior portions of the rocker member 28 have attached thereto a cover or button 32 which may be of a suitable opaque plastic material. The rocker member is movable laterally about pin 30 to a position shown in dashed outline on either side of the center position shown in solid outline in FIGS. 1 and 2. The housing 12 may also have a printed circuit board mounted therein for auxiliary electronic circuitry; and, if desired, a relay is mounted on the printed circuit board.

External electrical connector terminals shown typically at 38,40 are provided for external circuit connection thereto. In the present practice of the invention the switch is connected to separate circuits for a windshield wiper drive motor and a windshield washer pump motor.

Referring to FIG. 1, a pair of spaced generally parallel arcuately shaped contact strips 42,44 are mounted on the housing interior and connected to appropriate leads, as for example, on the printed circuit board for connection to appropriate ones of the external electrical connector terminals. A shorting contact carrier 46 is mounted on the rocker 28 for movement therewith. Carrier 46 has a pair of contact surfaces 48,50 formed thereon in spaced relationship. It will be understood that for the presently desired operation contact surface 48 is disposed to maintain continuous contact with strip 44; and, contact surface 50 is disposed for continuous contact with stationary contact strip 42.

In operation, if the user pushes the rocker button to the clockwise or counter-clockwise position about the pivot 30, the contact surfaces 48,50 will slide on strips 44,42 and maintain contact thereon.

Strip 42 is broken into two segments 42,43 by a discontinuity or gap 41 which is located at approximately two thirds the arcuate length thereof as shown in FIG. 1.

Contact strip 44 is divided into two segments 44,45, as shown; and, the strip has a discontinuity or gap 47 provided thereon at about one third the arc length thereof on the opposite side of the center position from the gap 41.

In operation, it will be understood that, as the shorting contact carrier 46 is moved by clockwise rotation of rocker 28, the circuit is switched from strips 42 and 45 to completing a circuit between strips 44 and 42. Similarly upon, counter-clockwise rotation of rocker 28 about pivot 30, the carrier is moved from a position switching current flow between strips 45 and 42 to a position provided current flow between strip 45 and strip 43. In the present application of the switch for automotive wipe/wash function control, the pivotal movement of the rocker 28 effects switching for controlling power to the windshield wiper motor.

In the clockwise "ON" position of the rocker completing the circuit between contact strips 44 and 42 delay circuit is energized on the board 34 for intermittent wiper operation. Conversely, rotation from the center or neutral position to the counter-clockwise portion of the rocker 28 about the pivot 30 completes a circuit between strips 45 and 43 to continuously energize the wiper motor.

It will be understood that sliding movement of the slider member 18 may be accomplished without effecting the contact of surfaces 48 and 50 of the carrier 46 on any of the contact strips shown in FIG. 1, because the strips are of sufficient width to accommodate the sliding movement of member 18.

Referring to FIG. 2, the opposite side of the switch housing is shown with portions broken away; and, on which side rocker 28 has a single point or bullet contact 60 for contacting a pair of generally parallel spaced arcuately configured contact strips 62,64 provided on the interior of the housing, which strips are electrically continuous, and have no discontinuities therein. The strips 62,64 in the present application are connected to appropriate ones of the electrical terminal connectors for external connection to a separate circuit such as a windshield washer pump motor. The upper contact strip 62 has provided thereon a pair of detent surfaces 66,68 disposed on opposite sides of the center position, and which serve to provide a detent action to pivotal movement of the rocker 28.

It will be understood that either clockwise or counter-clockwise pivotal movement of rocker 28 causes the contact 60 to maintain continuous electrical contact with strip 62.

Referring to FIG. 2, upon user movement of the rocker 32 downward, the slider 18 is caused to move downward compressing the springs 24,26, and moving contact 60 downwardly to the position shown in dashed outline, whereupon it shorts across strips 62,64 and completes a circuit therebetween. Completion of the circuit between strips 62,64 provides current flow to a second circuit such as the windshield washer pump motor. It will be understood that with the slider member 18 in the downward position and contact 60 shorting between 62 and 64 that contact between the strips 62 and 64 is maintained for either pivotal position of the rocker 28; and, thus the windshield washer pump may be actuated irrespective of which mode of operation the wiper motor is being operated.

If desired, a course of illumination such as LED70 may be provided for illuminating the rocker 28 and providing illumination to the exposed surface portion 72 which extends through an aperture 74 provided in the button 32.

The present invention thus provides a unique and novel type switch having a center "OFF" position and selected "ON" positions for a first switching function effected by either clockwise—or counter-clockwise rotation thereof about the rocker pivot. A second switching function is provided by push-to-actuate movement of the rocker and slider which effects switching of a second circuit, irrespective of the selected pivotal "ON" position of the rocker. The present invention provides the aforesaid combined functions with a plurality of arcuately shaped contact strips disposed on the housing. One set of strips is segmented for providing switching by a shorting contact upon pivotal movement of the rocker. The second arcuate set of contact strips is disposed to maintain contact continuously with a second shorting contact which shorts between the two strips on the push-to-actuate sliding movement of the member and provides such shorting functions for any pivotal position of the rocker. Thus, the present invention provides a combined rocker type and push-to-actuate switch usable for automotive wash/wipe motor control and provides a simple, reliable, and easy-to-manufacture switch construction employing spring loading shorting contacts for sliding against the contact strips to give reliable operation.

Although the invention has hereinabove been described with respect to the illustrated embodiments, it will be understood that the invention is capable of modification and variation, and is limited only by the scope of the following claims.

I claim:

1. A bi-directionally actuatable switch comprising:

(a) housing means including connector terminal means adapted for circuit connection thereto;

(b) collar means mounted for sliding movement on said housing means between a first and second position;

(c) rocker means mounted on said collar means for pivotal movement in opposite directions from a neutral position between first and second pivotal positions and having first portions thereof user accessible exteriorly of said housing means and second portion thereof extending interiorly of said housing means;

(d) first shorting contact means disposed on said second portions of said rocker means a first distance from the center of pivotal movement; and, second shorting contact means connected to said first shorting contact means and disposed on said second portions of said rocker means a second distance greater than said first distance from the center of said pivotal movement;

(e) first and second stationary contact strip means disposed on said housing means, said first contact strip means located for sliding contact by said first shorting contact means when said collar means is in either of said first and second positions whereupon said first contact strip means is operative upon said rocker pivotal movement to said first position to effect switching of a first circuit; and, (f) said second stationary contact strip means is located for sliding contact by said second shorting contact means and is operative for effecting switching of a second circuit when said rocker means is in said second pivotal position with said collar means in either of said first and second positions; and, (g) means connecting said first and second contact strip means to said connector terminal means.

* * * * *